US009543702B2

(12) United States Patent
Horiuchi

(10) Patent No.: US 9,543,702 B2
(45) Date of Patent: Jan. 10, 2017

(54) CONNECTOR

(71) Applicant: Sumitomo Wiring Systems, Ltd., Yokkaichi, Mie (JP)

(72) Inventor: Hidefumi Horiuchi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/785,939

(22) PCT Filed: May 8, 2013

(86) PCT No.: PCT/JP2013/062977
§ 371 (c)(1),
(2) Date: Oct. 21, 2015

(87) PCT Pub. No.: WO2014/181416
PCT Pub. Date: Nov. 13, 2014

(65) Prior Publication Data

US 2016/0079705 A1 Mar. 17, 2016

(51) Int. Cl.
*H01R 13/639* (2006.01)
*H01R 13/641* (2006.01)

(52) U.S. Cl.
CPC ..... *H01R 13/639* (2013.01); *H01R 13/641* (2013.01)

(58) Field of Classification Search
USPC ..... 439/345, 489, 595, 358
See application file for complete search history.

(56) References Cited

U.S. PATENT DOCUMENTS 6,769,929 B2 8/2004 Saka et al.
6,929,499 B2 * 8/2005 Nakamura ..... H01R 13/641 439/352
7,059,902 B2 * 6/2006 Nakamura ..... H01R 13/641 439/489
7,476,123 B2 * 1/2009 Kobayashi ..... H01R 13/4361 439/352

(Continued)

FOREIGN PATENT DOCUMENTS

JP 10-189115 7/1998
JP 2000-268917 9/2000

(Continued)

OTHER PUBLICATIONS

International Search Report.

*Primary Examiner* — Alexander Gilman
(74) *Attorney, Agent, or Firm* — Gerald E. Hespos; Michael J. Porco; Matthew T. Hespos

(57) ABSTRACT

A connector has a housing (10) with a lock arm (18) and a slider (60) that is movable on the housing (10) between an advanced position and a retracted position. A deflection regulating portion (67) projects from the slider (60) into a deflection space (24) for the lock arm (18) on a rear part of the lock arm (18) when the slider (60) is at the retracted position. The deflection regulating portion (67) is configured to regulate deflection of a lock arm (18). The slider (60) includes an unlocking portion (64) configured to cover a releasing surface of the lock arm (18) from a side opposite the deflection space (24) at the advanced position and has a shape suspended toward the deflection space (24). The unlocking portion (64) presses the releasing surface by receiving an operation force (F) that deflects the lock arm (18) in an unlocking direction.

4 Claims, 16 Drawing Sheets

(56) References Cited

U.S. PATENT DOCUMENTS

| | | | | |
|---|---|---|---|---|
| 7,828,581 | B2 * | 11/2010 | Okayasu | H01R 13/4362<br>439/352 |
| 2003/0186579 | A1 * | 10/2003 | Saka | H01R 13/6272<br>439/489 |
| 2008/0293300 | A1 * | 11/2008 | Katsuma | H01R 13/4367<br>439/595 |

FOREIGN PATENT DOCUMENTS

| | | |
|---|---|---|
| JP | 3419689 | 4/2003 |
| JP | 2004-6071 | 1/2004 |
| JP | 2004-134259 | 4/2004 |
| JP | 2011-165443 | 8/2011 |

* cited by examiner

CONNECTOR

BACKGROUND

1. Field of the Invention

The present invention relates to a connector.

2. Related Art

A connector disclosed in Japanese Patent No. 3419689 is provided with a housing (female housing) connectable to a mating housing and a slider (spring holder) to be mounted movably to an advanced position and a retracted position with respect to the housing. The housing includes a lock arm. In the process of connecting the two housings, the lock arm is deflected and deformed. When the two housings are properly connected, the lock arm is displaced in a return direction to be locked to the mating housing, whereby the two housings are held in a connected state.

The slider is supported slidably on the lock arm. The slider is held at the advanced position in the process of connecting the two housings and brought to the retracted position by a spring force of a coil spring when the two housings are connected properly. Further, the slider includes an unlocking portion covering a rear end part of the lock arm from above (side opposite to a deflection space for the lock arm) at the refracted position.

When the slider is pushed forward against the spring force of the coil spring and the unlocking portion is pushed down in that state by receiving an operating force in the case where the two housings are in a properly connected state, the rear end part of the lock arm is pushed down toward the deflection space, whereby a locked state of the lock arm is released and the two housings can be pulled apart from each other. Thus, according to the above configuration, there is an advantage of more easily securing a wide operation area for an unlocking operation than when unlocking is effected by directly pressing the rear end part of the lock arm.

However, in the above case, if the operation area of the unlocking portion is made excessively wide, a height of the unlocking portion tends to become larger and a height of the entire connector may become larger. Particularly, if the rear surface of the unlocking portion is used as an operating surface for pushing when the slider is pushed to the advanced position, the height of the unlocking portion becomes even larger.

Further, since the slider is only placed on the upper surface of the lock arm, external matters such as a wire easily enter the deflection space arranged below the rear end part of the lock arm. If a wire having entered the deflection space is lifted upwardly, the lock arm may be caught by the wire and turned up.

The present invention was completed based on the above situation and aims to provide a connector capable of avoiding the turning up of a lock arm and suppressing a height increase.

SUMMARY

The present invention is directed to a connector with a housing with opposite front and rear ends. The housing is connectable to a mating housing from the front and a slider is mounted movably to an advanced position and a retracted position behind the advanced position with respect to the housing. The slider is held at the advanced position while the housing is being connected to the mating housing and is permitted to move to the retracted position in a state where the housing is connected properly to the mating housing. The housing includes a housing main body and a lock arm facing the housing main body via a deflection space. A rear end part of the lock arm is deflected and deformed into the deflection space in the process of connecting the housing to the mating housing and the lock arm is displaced in a return direction to hold the mating housing in a connected state when the housing is connected properly to the mating housing. The slider includes a deflection regulating portion configured to regulate the deflection of the lock arm by entering the deflection space at the retracted position. The slider also includes an unlocking portion configured to cover the rear end part of the lock arm from a side opposite to the deflection space at a position reached when the slider is pushed forward from the retracted position. The unlocking portion includes a shape suspended toward the deflection space and capable of releasing a locked state of the lock arm by receiving an operation force and pressing the rear end part of the lock arm toward the deflection space.

When the slider is pushed forward from the retracted position and, in that state, the unlocking portion receives an operating force, the rear end part of the lock arm is pressed toward the deflection space by the unlocking portion. Thus, the locked state of the lock arm is released and the two housings can be pulled apart from each other. The unlocking portion includes the shape suspended toward the deflection space and the deflection regulating portion is configured to enter the deflection space. As a result, a height increase of the connector as a whole can be suppressed. Further, the shape suspended toward the deflection space impedes entry of external matter, such as wires, into the deflection space for the lock arm and other external forces are also unlikely to act. Thus, the turning-up of the lock arm can be avoided.

The slider may include a pressing surface that is pressed when the slider is pushed forward from the retracted position, separately from the unlocking portion. The pressing surface may be arranged at a position overlapping the unlocking portion in a width direction intersecting with a moving direction of the slider. The pressing surface of the slider is provided separately from the unlocking portion. Therefore, the unlocking portion does not become unnecessarily large and a height reduction of the connector is realized easily. Further, the pressing surface is arranged at the position overlapping the unlocking portion in the width direction. As a result, a pressing means, such as fingers, easily can be shifted from the pressing surface to the unlocking portion and the interruption of an operation can be reduced.

The slider includes a turning-up regulating portion located at the same side as the unlocking portion with respect to the lock arm and configured to cover the lock arm from the front at the advanced position. This can avoid the turning-up of the lock arm even against external members and external forces not only from behind, but also from front.

DETAILED DESCRIPTION

Figure 1:
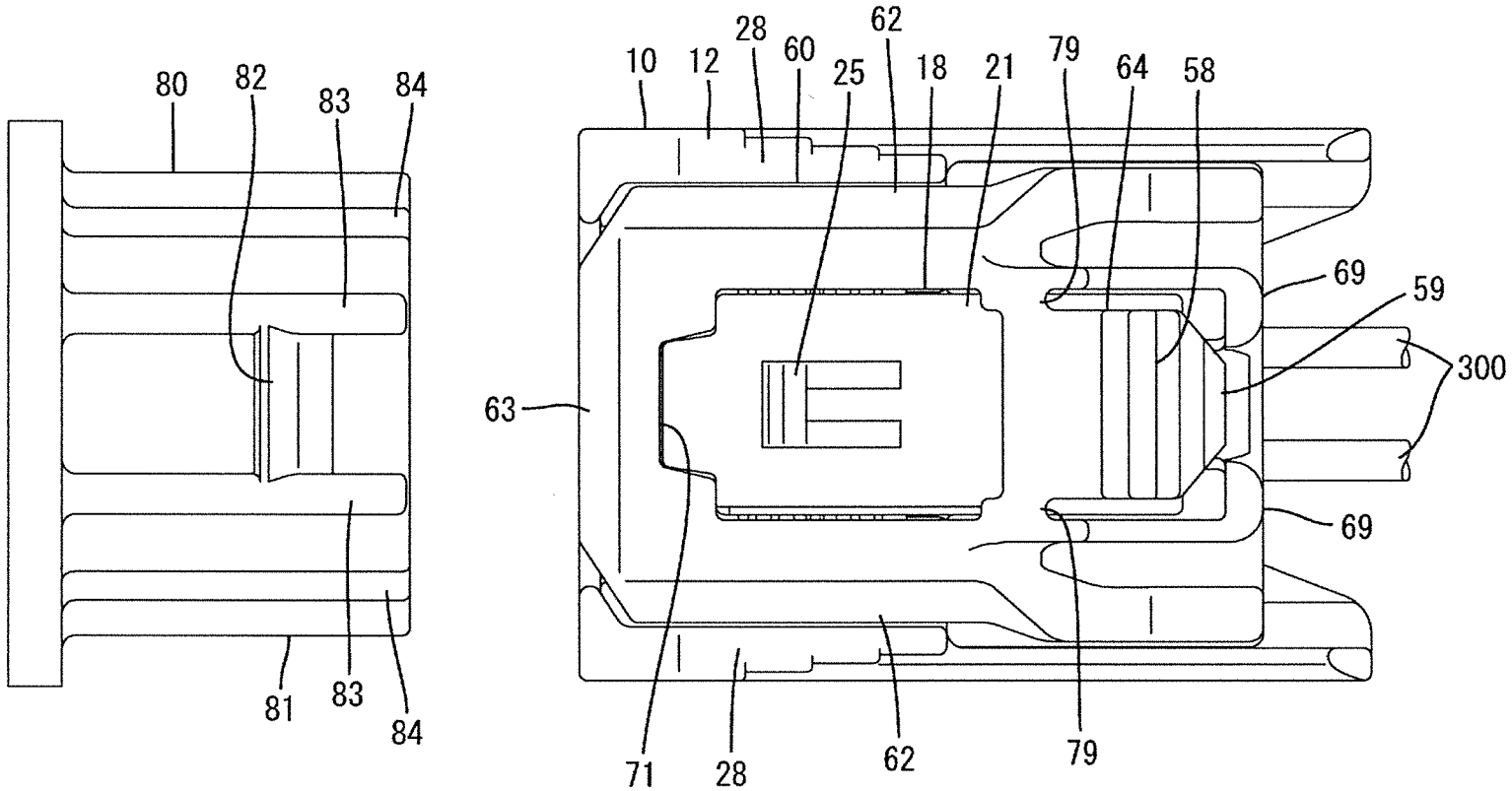
FIG. 1 is a plan view of a connector of a first embodiment of the present invention showing a state where a slider is mounted at an advanced position and opposed to a mating housing.

A first embodiment of the present invention is described with reference to FIGS. 1 to 15. A connector of the first embodiment includes a housing 10 connectable to a mating housing 80, a slider 60 to be movably mounted on the housing 10, spring members 90 to be assembled with the slider 60 and terminal fittings 100 to be accommodated into the housing 10. Note that, in the following description, a side where the mating housing 80 is located at the time of connection is referred to as a front side concerning a front-back direction and a vertical direction is based on FIG. 12.

Figure 2:
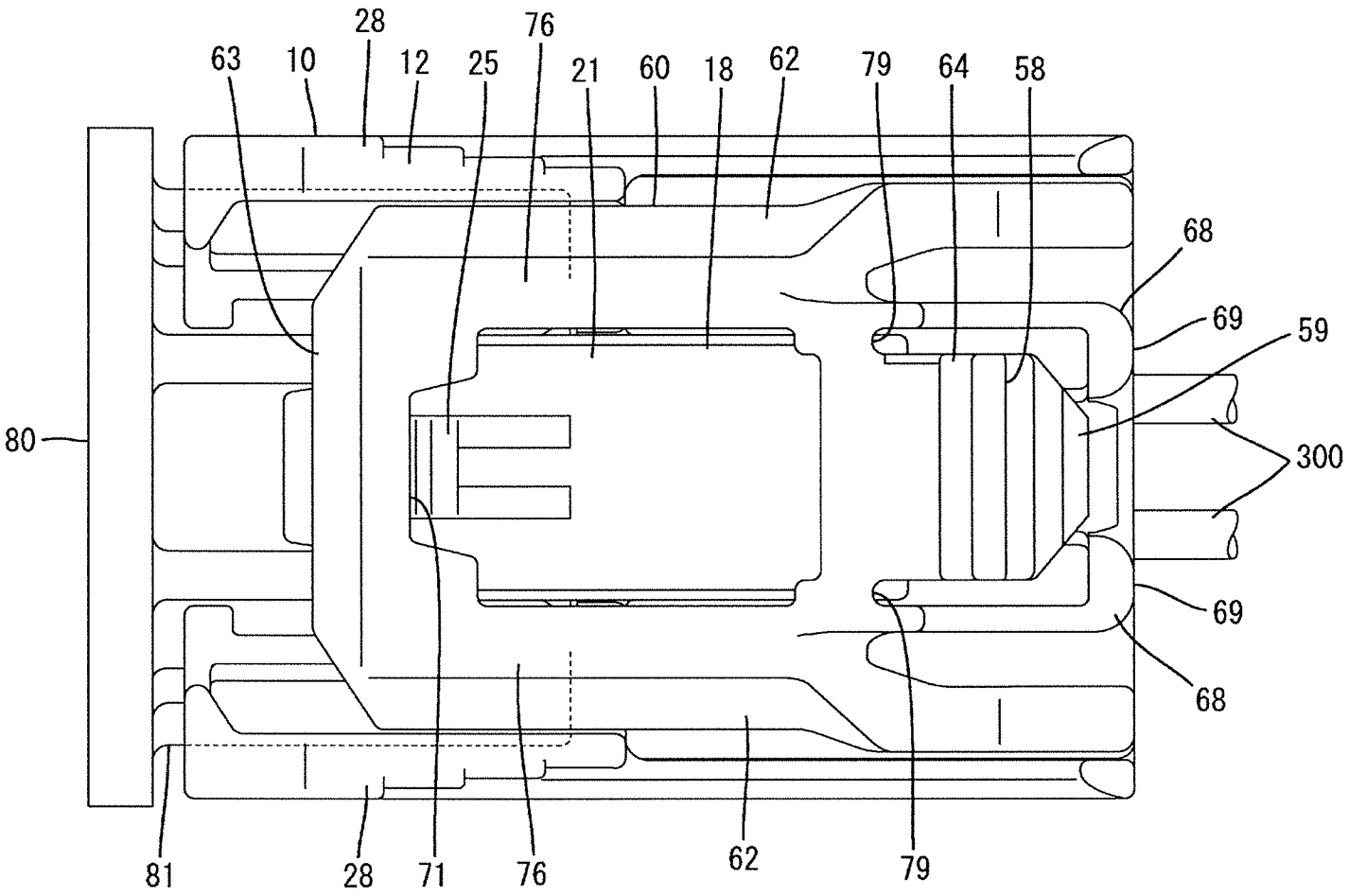
FIG. 2 is a plan view showing a state where the connector is properly connected to the mating housing and the slider is displaced to a refracted position.
Figure 3:
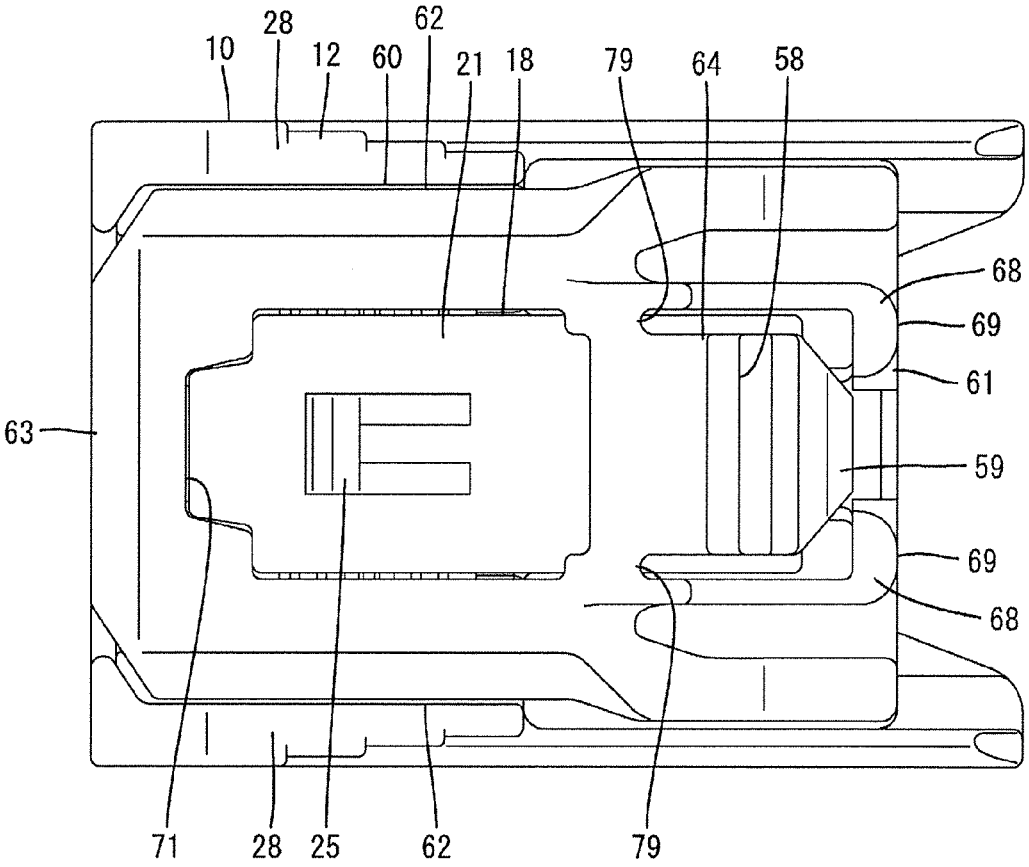
FIG. 3 is a plan view of a housing on which the slider is mounted at the advanced position.

The mating housing 80 is made of synthetic resin and includes, as shown in FIGS. 1 and 2, a tubular receptacle 81. Male tabs 210 of mating terminal fittings 200 are arranged to project in the receptacle 81. A lock portion 82 is provided to project on the upper surface of the upper wall of the receptacle 81. Further, a pair of guide projections 83 for guiding a connecting operation of the two housings 10, 80 are formed to extend in the front-back direction at opposite widthwise sides of the lock portion 82 on the upper surface of the upper wall of the receptacle 81. Furthermore, a pair of pressing portions 84 for pressing the spring members 90 in the process of connecting the two housings 10, 80 are formed to extend in the front-back direction at outer sides of the both guide projections 83.

Figure 4:
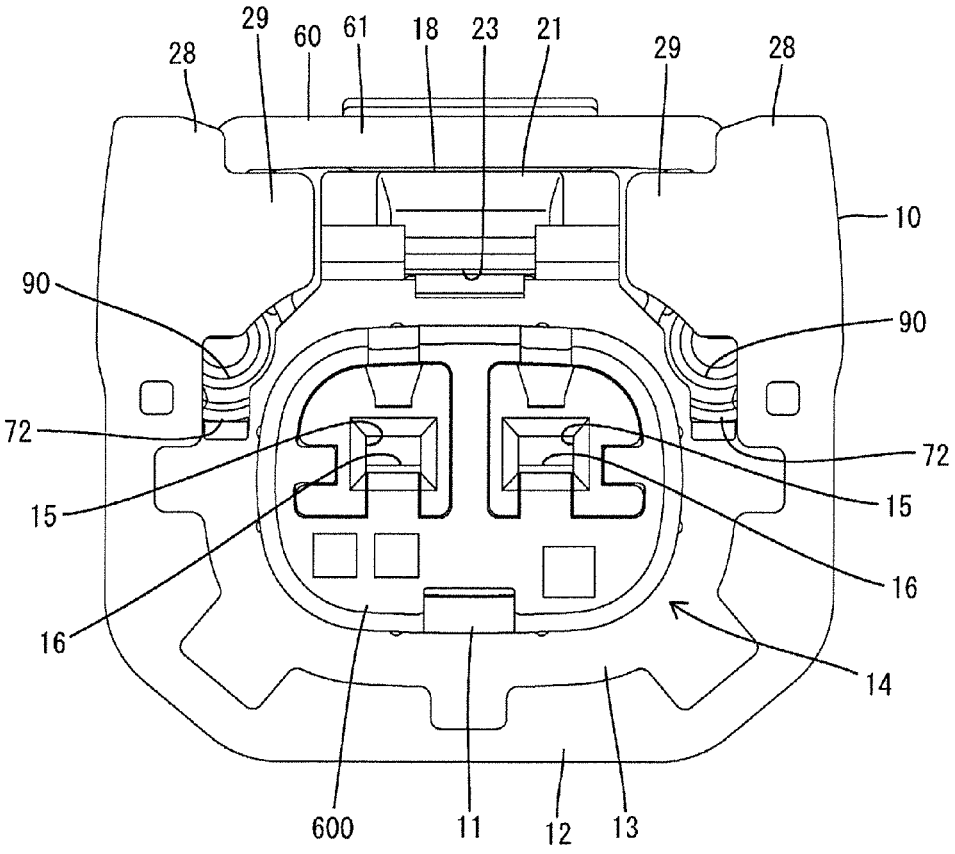
FIG. 4 is a front view of the housing on which the slider is mounted at the advanced position.
Figure 7:
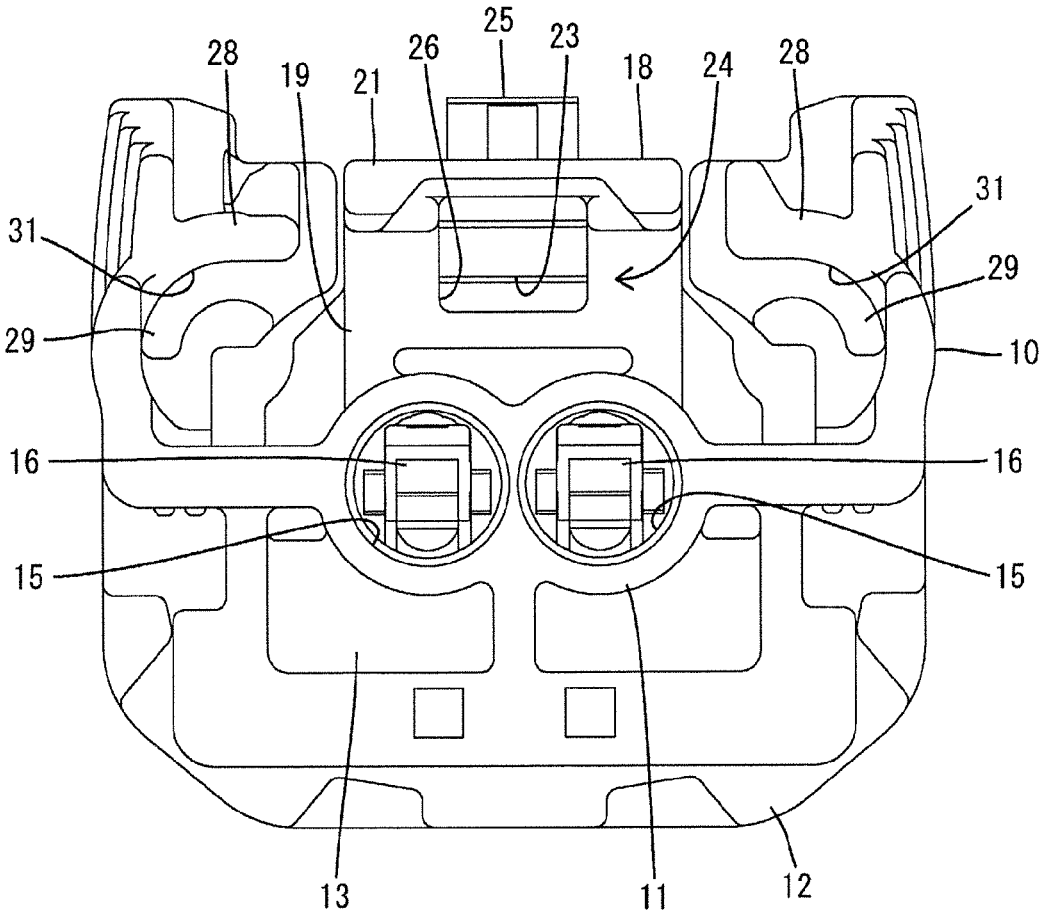
FIG. 7 is a rear view of the housing.
Figure 12:
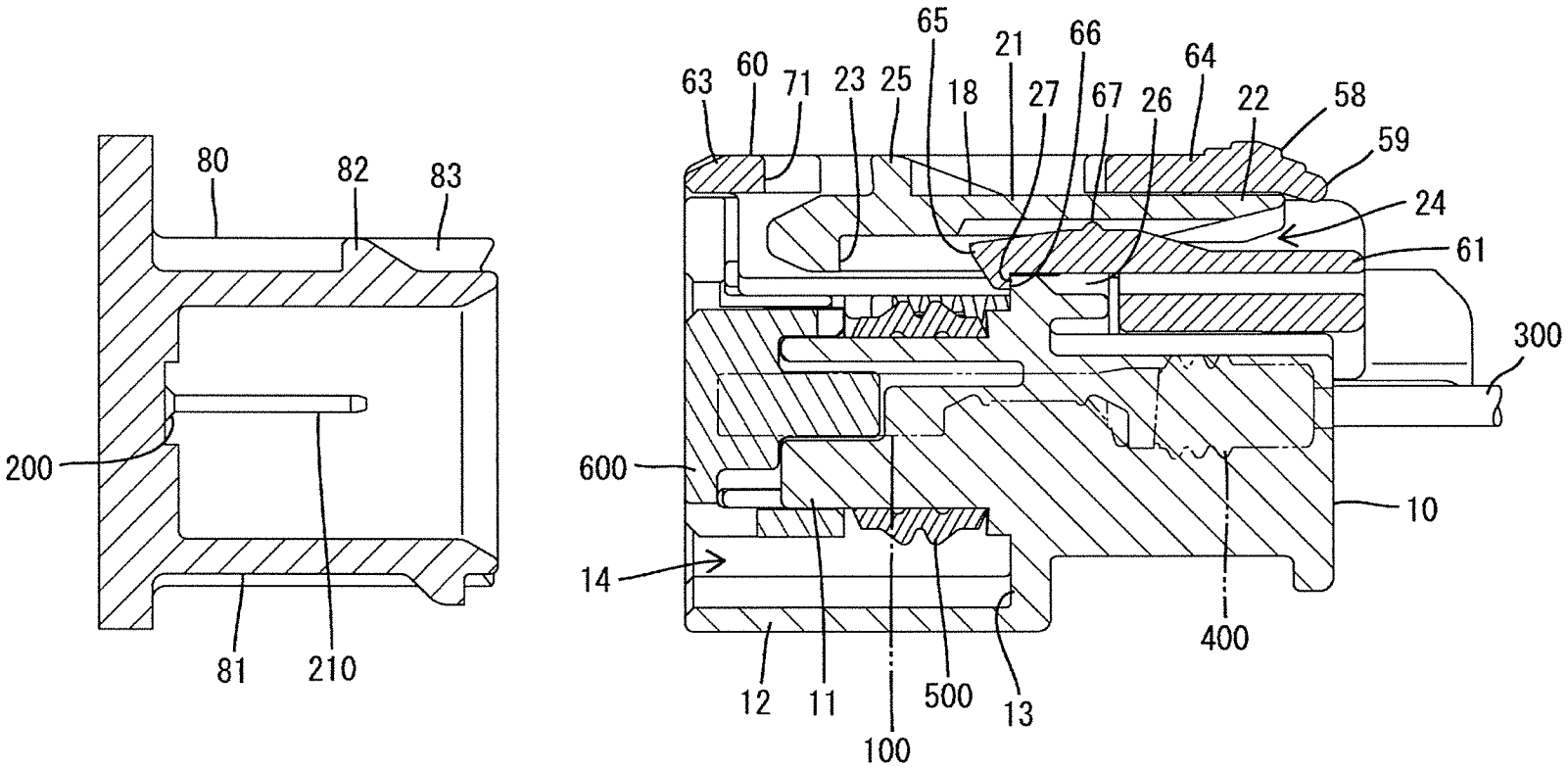
FIG. 12 is a section showing the state where the slider is mounted at the advanced position and opposed to the mating housing.

The housing 10 is made of synthetic resin and includes, as shown in FIGS. 4 and 12, a block-like housing main body 11, a tubular fitting tube portion 12 surrounding the housing main body 11 and a radially extending linking portion 13 linking the fitting tube portion 12 and the housing main body 11. A connection space 14 into which the receptacle 81 is fittable is formed to be open forward between the housing main body 11 and the fitting tube portion 12 and before the linking portion 13. A plurality of cavities 15 are formed to penetrate through the housing main body 11 in the front-back direction. In the case of the first embodiment, a pair of cavities 15 are arranged side by side and deflectable locking lances 16 are formed to project forward at lower surfaces as shown in FIG. 7. The terminal fitting 100 is inserted into each cavity 15 from behind.

Figure 13:
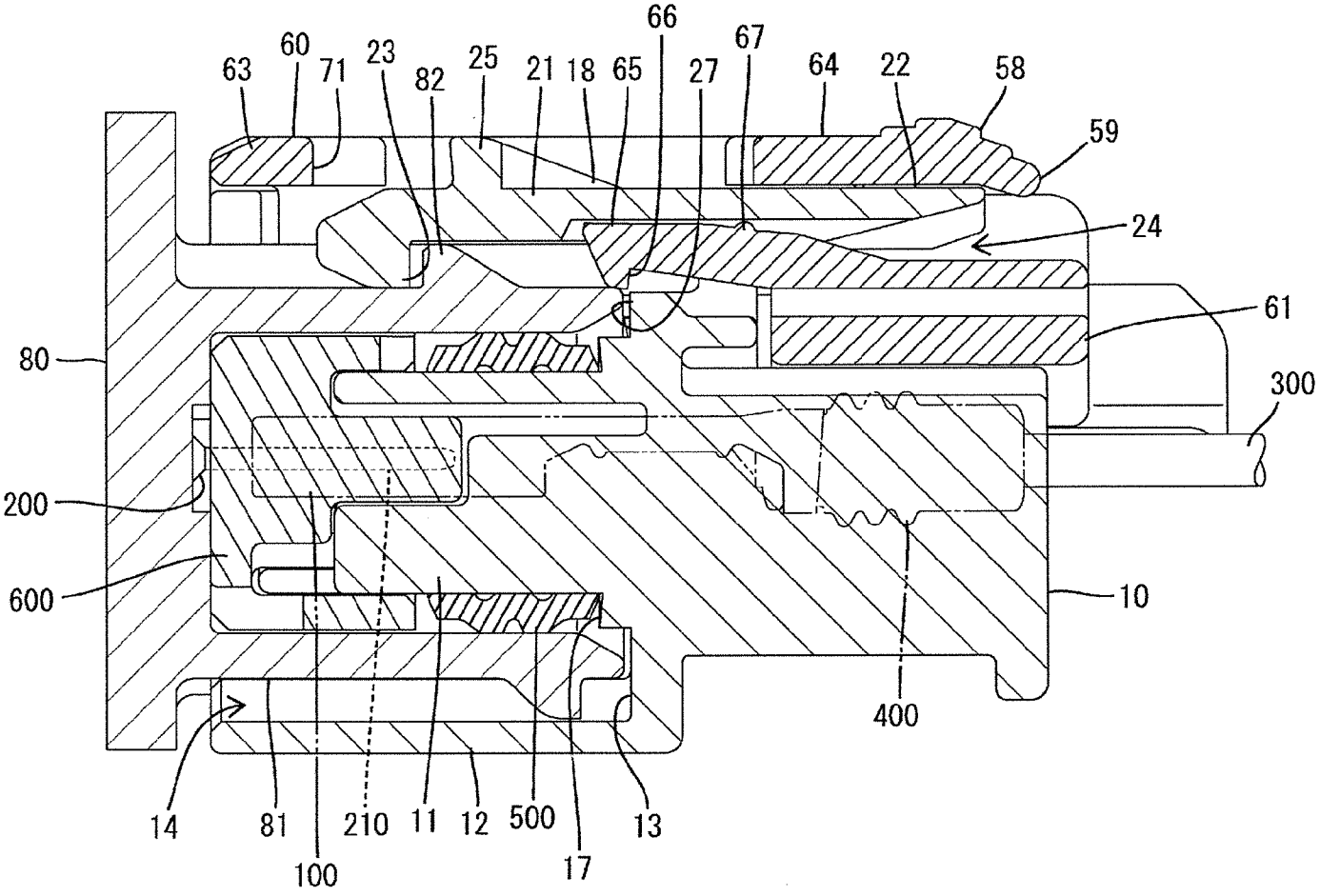
FIG. 13 is a section showing a state where the connector is properly connected to the mating housing and a locking projection of a stopper is disengaged from a stopping portion.

As shown in FIG. 13, the terminal fitting 100 includes a part into which the male tab 210 of the mating terminal fitting 200 is inserted for connection and a part located behind the former part and to be connected to a conductor part of a wire 300 and a rubber plug 400 fitted on the wire 300. When being properly inserted into each cavity 15, the terminal fitting 100 is resiliently retained by the corresponding locking lance 16, the rubber plug 400 is inserted in a liquid-tight manner into a rear end part of the cavity 15 and the wire 300 is drawn out to outside from the rear end of the housing main body 11.

Figure 11:
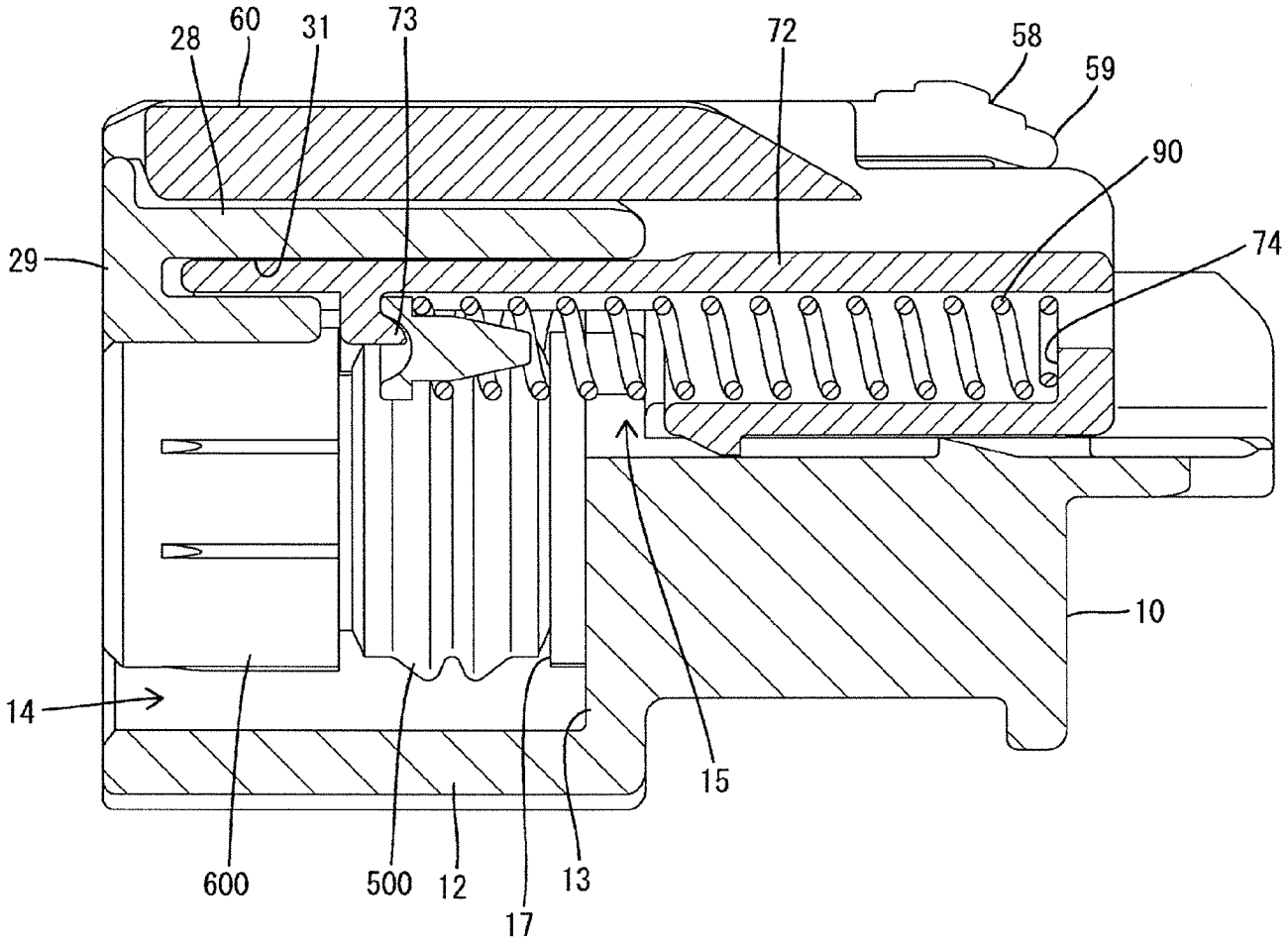
FIG. 11 is a section of the housing cut at a position corresponding to spring accommodating portions in the state where the slider is mounted at the advanced position.

As shown in FIG. 13, a step 17 is formed on the outer peripheral surface of the housing main body 11 and a seal ring 500 is fitted before the step 17. When the two housings 10, 80 are connected, the receptacle 81 is inserted into the connection space 14 of the housing 10 and the seal ring 500 is resiliently compressed between the receptacle 81 and the housing main body 11 to hold the two housings 10, 80 liquid-tight. Further, a cap-like front member 60 is mounted onto the housing main body 11 from front. As shown in FIG. 11, the seal ring 500 is prevented from coming out forward by the front member 600 and prevented from coming out backward by the step 17.

Figure 14:
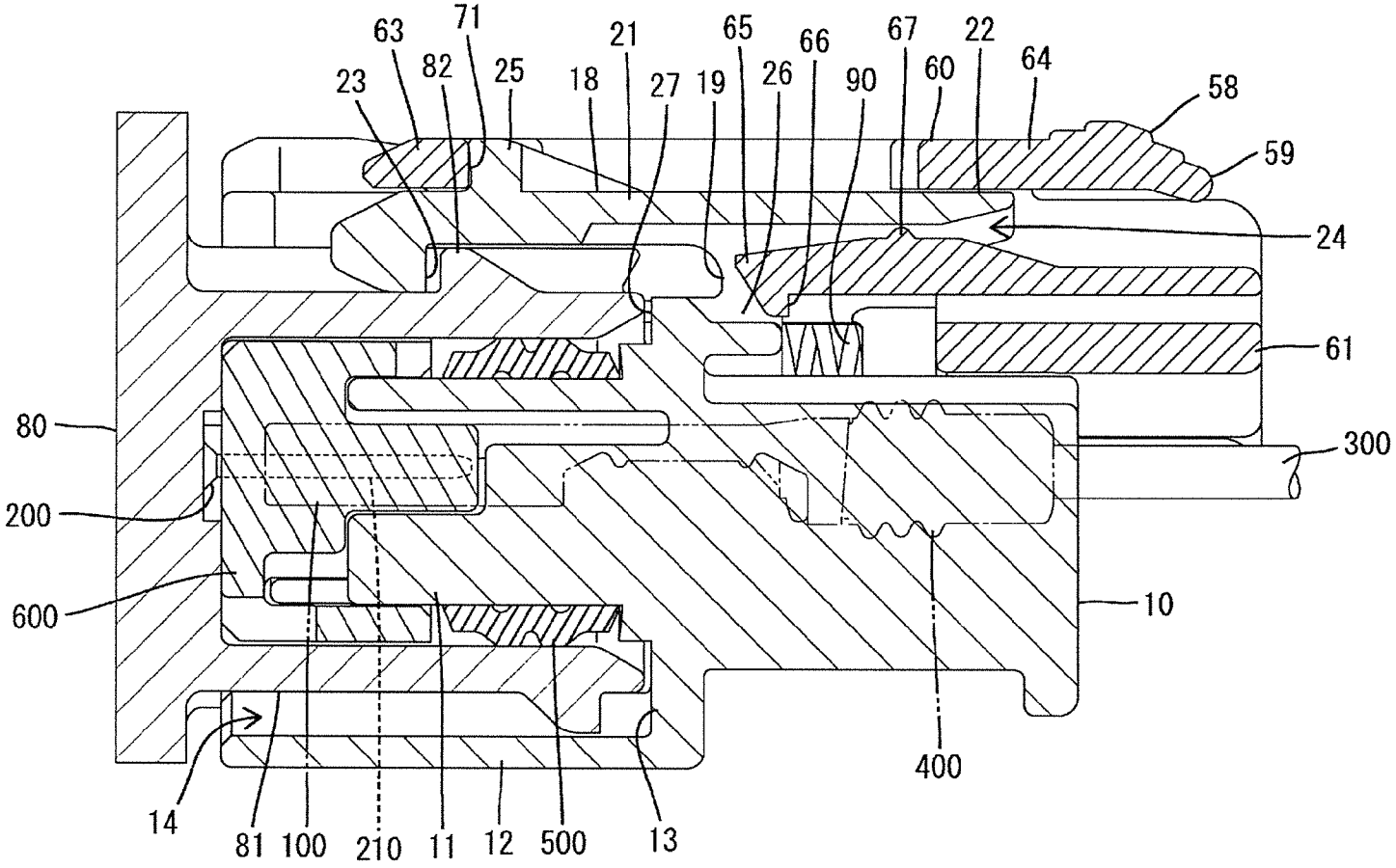
FIG. 14 is a section showing the state where the connector is properly connected to the mating housing and the slider is displaced to the retracted position.
Figure 15:
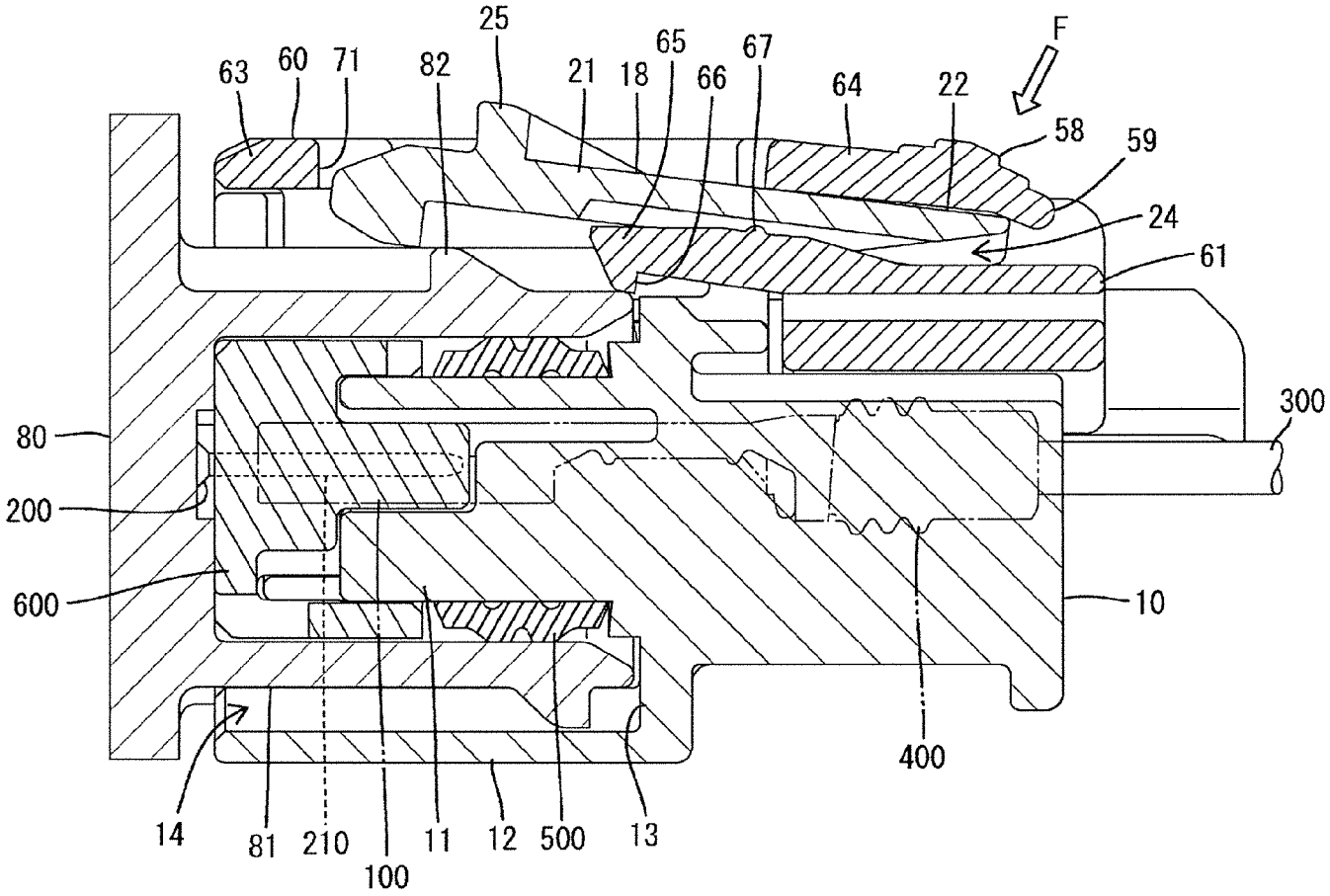
FIG. 15 is a section showing a state where the slider is pushed to the advanced position to deflect the lock arm in releasing a connected state to the mating housing.

Further, as shown in FIG. 14, a deflectable lock arm 18 is integrally coupled to the housing main body 11. The lock arm 18 includes a leg portion 19 standing up from the upper surface of the housing main body 11 and an arm main body 21 extending both forward and backward from the upper end of the leg portion 19. The rear end of the arm main body 21 is located more forward than that of the housing main body 11 and the entire length of the lock arm 18 is relatively short. The upper surface of a rear end part of the arm main body 21 is formed into a flat surface 22 substantially horizontal in a natural state, and the slider 60 can slide on this flat surface 22.

A lock projection 23 is formed to project downwardly in a substantially widthwise central part of a front end part of the arm main body 21. In the process of connecting the two housings 10, 80, the lock projection 23 interferes with the lock portion 82 and the arm main body 21 is deflected and deformed (inclined) with the leg portion 19 as a supporting point. When the two housings 10, 80 are properly connected, the arm main body 21 is resiliently displaced in a return direction to substantially return to the natural state and, as shown in FIG. 13, the lock projection 23 is arranged to be lockable to the lock portion 82 to hold the two housings 10, 80 in a connected state. Note that a deflection space 24 for the lock arm 18 is secured between the rear end part of the arm main body 21 and the upper surface of the housing main body 11.

Figure 6:
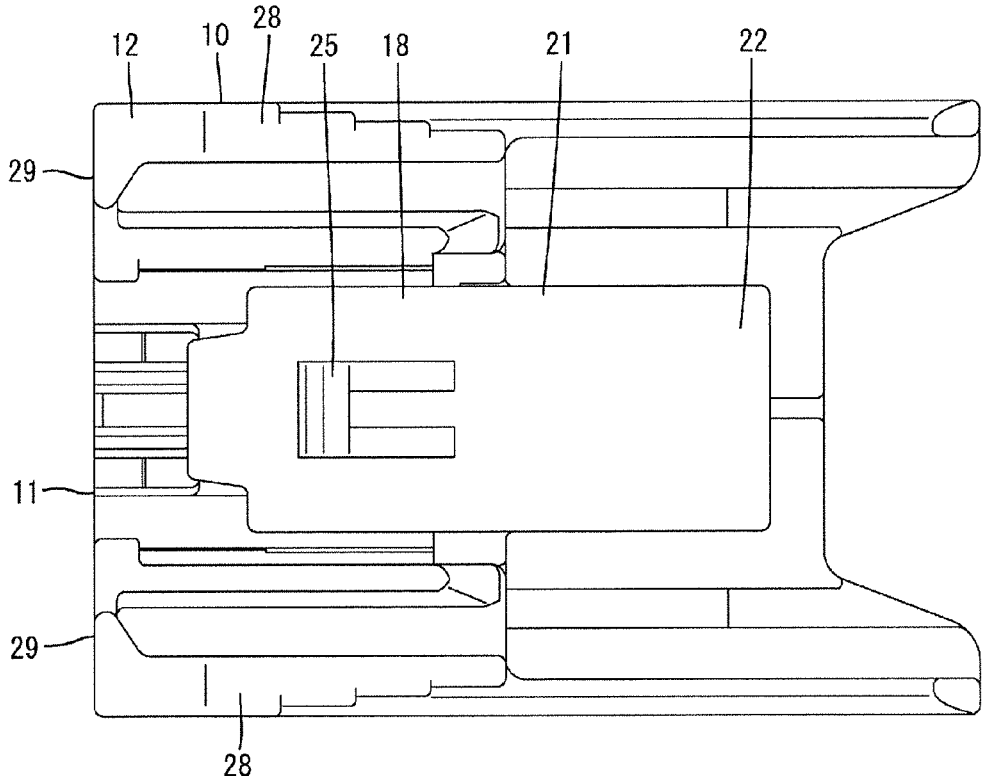
FIG. 6 is a plan view of the housing.

As shown in FIG. 14, a holding portion 25 for regulating a backward detachment of the slider 60 is provided to project on a front end part of the upper surface of the arm main body 21. As shown in FIG. 6, the holding portion 25 is in the form of a rib extending in a width direction.

Further, as shown in FIG. 7, a through hole 26 penetrating in the front-back direction is formed in a substantially widthwise central part of the leg portion 19. As also shown in FIG. 12, a stepped stopping portion 27 is provided on the upper surface of the housing main body 11 below the through hole 26 on the front surface of the leg portion 19 and behind the step 17. A later-described stopper 65 of the slider 60 penetrates through the through hole 26 and a later-described locking projection 66 formed on a front end part of the stopper 65 having penetrated through the through hole 26 is locked to the stopping portion 27, thereby regulating a backward movement (movement to a retracted position to be described later) of the slider 60.

As shown in FIGS. 6 and 7, a part of the upper wall of the fitting tube portion 12 facing the lock arm 18 is open and the upper surface of the lock arm 18 is exposed in this part. Two guide walls 28 are provided at opposite widthwise sides of the lock arm 18 on the upper wall of the fitting tube portion 12.

As shown in FIG. 4, a pair of front stop walls 29 are formed to protrude inwardly (toward the lock arm 18) on the front ends of the both guide walls 28. Further, as shown in FIG. 11, a pair of guide grooves 31 extending backward from the rear ends of the front stop walls 29 are provided in the both guide walls 28. The slider 60 comes into contact with the both front stop walls 29 after sliding along the both guide grooves 31, whereby any further forward movement is regulated.

Next, the slider 60 is described. As shown in FIGS. 1 and 2, the slider 60 is mounted at inner sides of the both guide walls 28 of the housing 10 and movable in the front-back direction along the both guide grooves 31 between an advanced position (see FIG. 1) and a retracted position (see FIG. 2) with respect to the housing 10.

Figure 8:
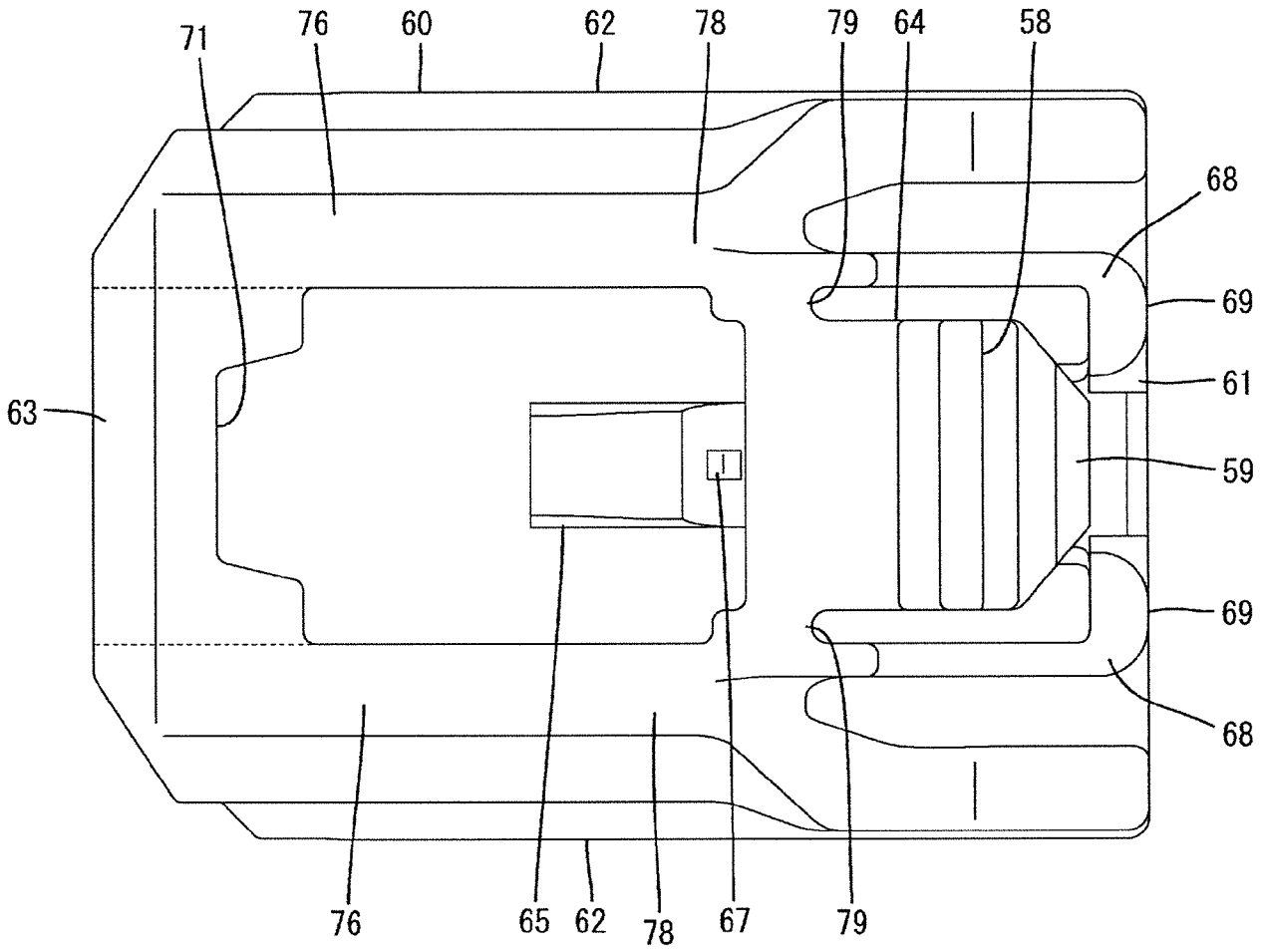
FIG. 8 is a plan view of the slider.
Figure 10:
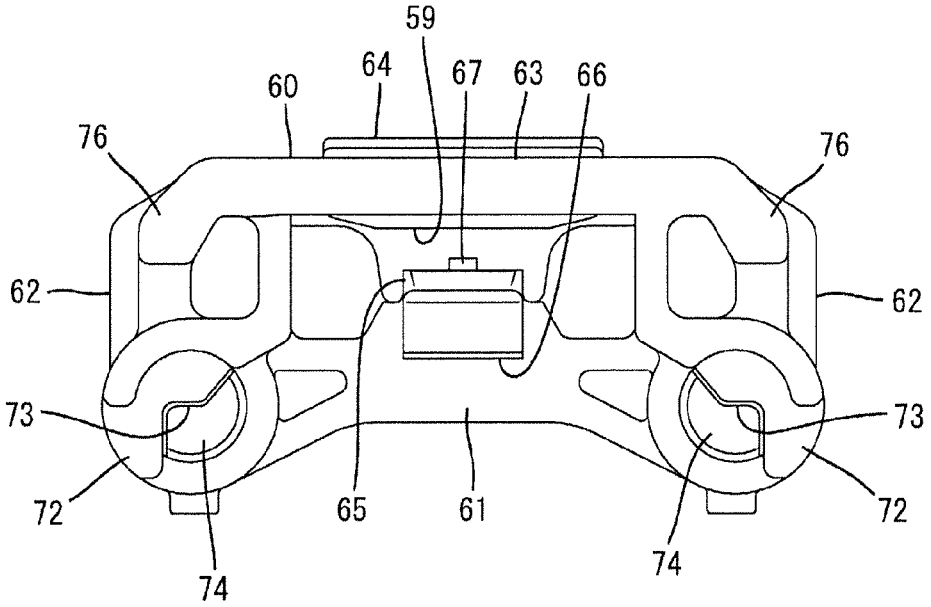
FIG. 10 is a front view of the slider.

Specifically, the slider 60 is made of synthetic resin and, as shown in FIG. 8, has a rectangular frame shape as a whole and includes a base portion 61 extending along the width direction, a pair of arm portions 62 projecting forward from opposite widthwise ends of the base portion 61, a coupling portion 63 (turning-up regulating portion) bridged between the front ends of the both arm portions 62 and extending along the width direction and an unlocking portion 64 coupled to intermediate parts of the both arm portions 62 in the front-back direction. As shown in FIG. 10, the coupling portion 63 and the unlocking portion 64 are located above the base portion 61 and arranged at different heights so as not to overlap the base portion 61 in a front view. As shown in FIG. 12, when the slider 60 is assembled with the housing 10, the coupling portion 63 and the unlocking portion 64 are located above the front end part of the lock arm 18 and the base portion 61 is located below the rear end part of the lock arm 18.

The base portion 61 includes the stopper 65. As shown in FIG. 10, the stopper 65 is cantilevered forward from a substantially widthwise center of the base portion 61 and deflectable. A locking projection 66 is formed to project downwardly on a front end part of the stopper 65. As shown in FIG. 12, when the slider 60 is at the advanced position, the locking projection 66 of the stopper 65 is hooked and locked to the stopping portion 27, whereby a movement of the slider 60 to the retracted position is regulated. Further, a deflection regulating portion 67 is provided to project on the upper surface of the stopper 65. The deflection regulating portion 67 is in the form of a small projection as shown in FIGS. 8 and 10 and enters the deflection space 24 of the housing 10 and is arranged in proximity to the lower surface of the rear end part of the arm main body 21 at the retracted position as shown in FIG. 14.

Figure 5:
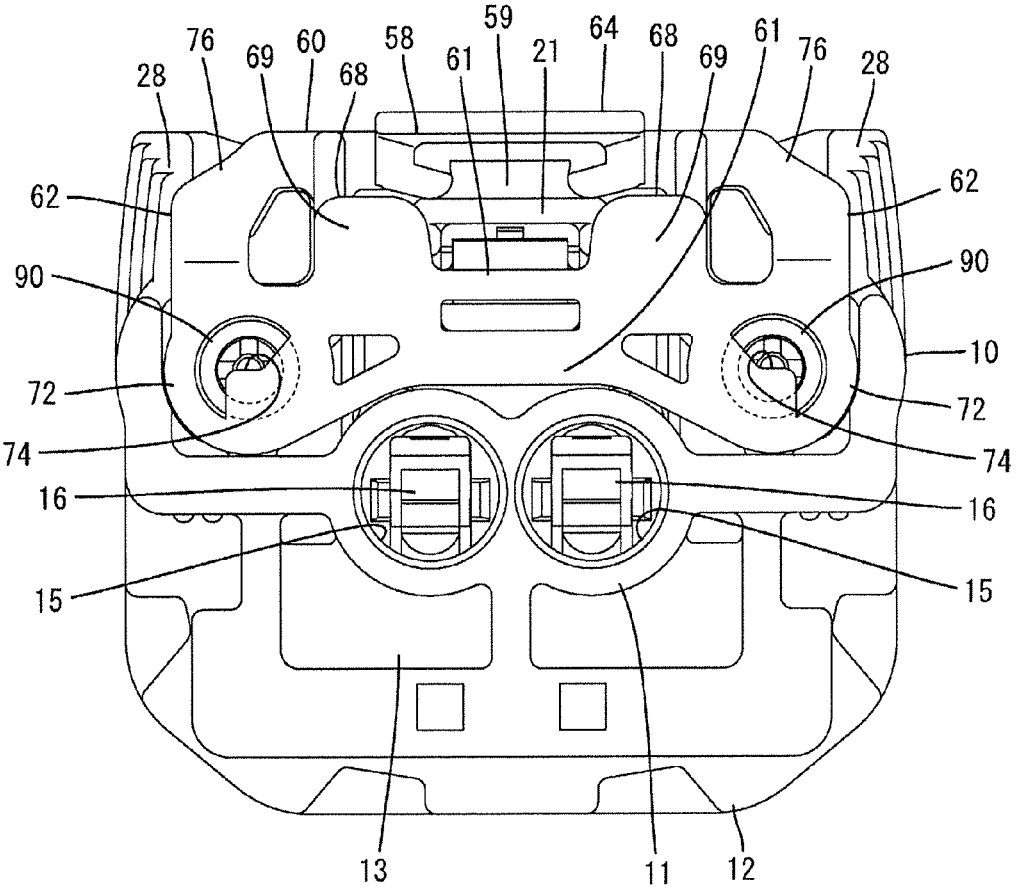
FIG. 5 is a rear view of the housing on which the slider is mounted at the advanced position.

Further, as shown in FIGS. 5 and 8, a pair of pressing portions 68 are provided on opposite widthwise sides of the base portion 61. The rear ends of the both pressing portions 68 serve as a pair of pressing surfaces 69, which are arranged to face backward and located more backward than the rear end of a suspended portion 59 to be described later.

As shown in FIG. 8, a held portion 71 substantially in the form of rectangular recess is formed in a substantially widthwise central part of the rear end of the coupling portion 63. As shown in FIGS. 2 and 14, when the slider 60 is at the retracted position, the holding portion 25 of the lock arm 18 is inserted into the holding portion 71 and rests in contact therewith, thereby regulating a backward detachment of the slider 60.

As shown in FIG. 10, a pair of spring accommodating portions 72 are provided in lower parts of the both arm portions 62. As shown in FIG. 11, the spring members 90 formed of known compression coil springs are accommodated in the spring accommodating portions 72.

The spring accommodating portion 72 has a substantially hollow cylindrical shape and the entire spring member 90 can be accommodated therein. As shown in FIG. 11, a front spring supporting portion 73 for receiving the front end of the spring member 90 is provided to face backward on the front end of the spring accommodating portion 72 and a rear spring supporting portion 74 for receiving the rear end of the spring member 90 is provided to face forward on the rear end of the spring accommodating portion 72. The front and rear spring supporting portions 73, 74 are arranged not to overlap each other in a front view since a mold is pulled out in the front-back direction when the slider 60 is molded. As shown in FIG. 11, the lower surface of a front part of the spring accommodating portion 72 is open as an introduction opening 75 for the spring member 90. When the spring member 90 is mounted into the spring accommodating portion 72, a lower part of the front end of the spring member 90 is arranged in an exposed manner below the front spring supporting portion 73 and can come into contact with the pressing portion 84 of the mating housing 80.

Further, as shown in FIG. 10, the both arm portions 62 include a pair of protection walls 76 standing up from the spring accommodating portions 72. As shown in FIG. 8, the upper surfaces of the both protection walls 76 are arranged to be continuous and substantially flush with the upper surface of the coupling portion 63. As shown in FIG. 5, when the slider 60 is assembled with the housing 10, the both protection walls 76 are arranged substantially at the same height position as the upper ends of the both guide walls 28 and cover opposite widthwise ends of the lock arm 18.

Figure 9:
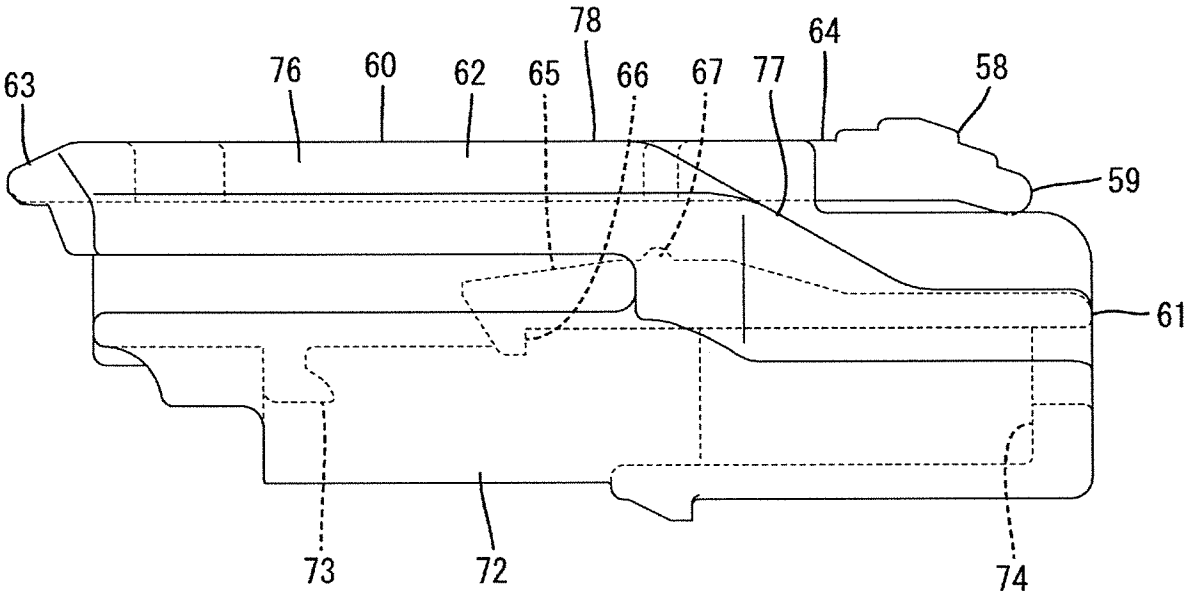
FIG. 9 is a side view of the slider.

As shown in FIG. 9, the upper surface of each of the both arm portions 62 has a slant 77 extending with an upward inclination from the base portion 61 toward the coupling portion 63 and a horizontal surface 78 extending in the front-back direction from the front end of the slant 77 to the coupling portion 63.

Further, the unlocking portion 64 is arranged above the base portion 61 and substantially at the same height position as the coupling portion 63. The unlocking portion 64 is in the form of a plate piece as shown in FIG. 8 and the upper surface thereof is substantially horizontally arranged substantially at the same height position as the horizontal surfaces 78 of the both arm portions 62 as shown in FIG. 9. Further, as shown in FIG. 8, a pair of coupling/supporting portions 79 are bridged between opposite widthwise ends of the front end of the unlocking portion 64 and the both arm portions 62. The both coupling/supporting portions 79 are coupled to rear end parts of the horizontal surfaces 78 of the both arm portions 62. The unlocking portion 64 is deflectable and deformable with the both coupling/supporting portions 79 as supporting points.

As shown in FIG. 9, a rear end part of the unlocking portion 64 serves as the suspended portion 59 inclined obliquely downwardly toward the back, and the lower surface of the suspended portion 59 is located lower than the lower surface of the other part of the unlocking portion 64. Further, as shown in FIG. 8, the suspended portion 59 has a trapezoidal shape in a plan view, specifically an isosceles trapezoidal shape in a plan view, gradually narrowed toward the back. A step-like operating surface 58 is formed on the upper surface of the suspended portion 59. This operating surface 58 is arranged to obliquely face an upper rear side and extends from the rear end of the upper surface of the unlocking portion 64 to a substantially central part in the front-back direction. Further, as shown in FIG. 5, the unlocking portion 64 is proximately arranged at a position above the pressing portions 68 and overlapping the pressing portions 68 in the width direction (direction intersecting with a moving direction of the slider 60).

The configuration of the first embodiment is as described above. Next, an assembling method and a connecting/separating operation of the connector are described.

The spring members 90 are accommodated into the spring accommodating portions 72 of the slider 60 and, in that state, the slider 60 is slid and inserted into a space at the inner sides of the both guide walls 28 of the housing 10 from behind. At this time, the slider 60 can be easily assembled by pressing the pressing surfaces 69 of the both pressing portions 68 from behind. As shown in FIG. 12, when the slider 60 is assembled at the advanced position, the stopper 65 penetrates through the through hole 26 and the locking projection 66 is resiliently hooked and locked to the stopping portion 27 to regulate a backward movement of the slider 60. Further, as shown in FIG. 11, at the advanced position, the front end parts of the spring accommodating portions 72 are fitted in the both guide grooves 31 of the housing 10 and the front ends of the spring accommodating portions 72 are arranged to be able to come into contact with the front stop walls 29, whereby a forward movement of the slider 60 is regulated. In this way, the slider 60 is held with forward and backward movements regulated.

When the slider 60 is assembled at the advanced position, the unlocking portion 64 covers the upper surface of the rear end part of the arm main body 21 and the rear end part of the arm main body 21 is not seen from above as shown in FIG. 1. At this time, as shown in FIG. 12, the suspended portion 59 is arranged to project obliquely downwardly to the back with a part facing the rear end of the upper surface of the arm main body 21 substantially as a starting point and cover the rear end of the arm main body 21 from behind. Further, when the slider 60 is assembled at the advanced position, the front end part of the slider 60 is located to surround the outer periphery of the front end part of the arm main body 21 and the coupling portion 63 is arranged to cover the front end of the arm main body 21 from front as shown in FIG. 1. Thus, external matters such as the wires 300 and external forces are unlikely to act on the opposite front and rear end parts of the arm main body 21, thereby preventing the turning-up of the lock arm 18.

Note that, as shown in FIG. 12, the deflection regulating portion 67 is located before the deflection space 24 for the lock arm 18 to permit the deflection of the lock arm 18 at the advanced position. Further, at the advanced position, the spring members 90 are held substantially in a natural state by having both front and rear ends supported on the front and rear spring supporting portions 73, 74.

In connecting the two housings 10, 80, the connecting operation proceeds by inserting the housing 10 into the receptacle 81 of the mating housing 80. In the connecting process, the both pressing portions 84 of the mating housing 80 come into contact with the lower parts of the front ends of the both spring members 90. As the connecting operation further proceeds, the front ends of the both spring members 90 are pressed by the both pressing portions 84 to be separated from the front spring supporting portions 73 and the spring members 90 are resiliently compressed while being supported on the rear spring supporting portions 74. The slider 60 is biased toward the retracted position by receiving spring forces of the spring members 90, but held at the advanced position by a locking action of the stopper 65.

In a final stage of the connecting process of the two housings 10, 80, the lock projection 23 of the lock arm 18 interferes with the lock portion 82 to deflect and deform the lock arm 18. As shown in FIG. 13, when the two housings 10, 80 reach a properly connected state, the lock arm 18 moves over the lock portion 82 and is displaced in the return direction and the lock projection 23 is arranged to be lockable to the lock portion 82. In this way, the two housings 10, 80 are held in a state connected to each other and, simultaneously, the terminal fittings 100 are properly electrically conductively connected to the mating terminal fittings 200.

Further, as shown in FIG. 13, when the two housings 10, 80 reach the properly connected state, the locking projection 66 of the stopper 65 is pressed against the front end of the upper wall of the receptacle 81 to release a locked state between the locking projection 66 and the stopping portion 27. Associated with that, accumulated spring forces of the spring members 90 are released and the spring members 90 return to the natural state. By the returning movements of the spring members 90, the rear spring supporting portions 74 of the slider 60 are pressed by the spring members 90 and the entire slider 60 moves backward and reaches the retracted position. At the retracted position, the spring members 90 have substantially returned to the natural state and, as shown in FIG. 14, the held portion 71 of the coupling portion 63 of the slider 60 comes into contact with the holding portion 25 of the arm main body 21, thereby regulating any further backward movement of the slider 60.

Further, when the slider 60 reaches the retracted position, the deflection regulating portion 67 is located in the deflection space 24 for the lock arm 18 and arranged in proximity to the arm main body 21. Thus, by the contact of the arm main body 21 with the deflection regulating portion 67, any further deflection of the lock arm 18 is regulated and the lock arm 18 is prevented from being inadvertently unlocked. Note that although the upper end of the operating surface 58 of the unlocking portion 64 is located at the highest position of the entire connector with the slider 60 assembled with the housing 10 at the retracted position or the advanced position, it is located only slightly above the upper end of the holding portion 25 of the arm main body 21.

On the other hand, if the connecting operation is stopped before the two housings 10, 80 reach the properly connected state, the pressing portions 84 are pushed back by the spring forces of the spring members 90 accumulated in the connecting process up to that point of time, thereby preventing the two housings 10, 80 from being left in an incompletely connected state. Further, an operator can visually confirm that the two housings 10, 80 have reached the properly connected state upon seeing that the slider 60 is at the retracted position.

In separating the two housings 10, 80 from each other for maintenance or other reason, the pressing surfaces 69 of the both pressing portions 68 are pressed by an unillustrated pressing means such as fingers or a jig and the slider 60 is pushed toward the advanced position. In the process of moving toward the advanced position, the spring members 90 are resiliently compressed and the pressing portions 84 are pressed by the spring members 90. Further, the deflection regulating portion 67 is retracted from the deflection space 24 for the lock arm 18 to permit the deflection of the lock arm 18.

When the deflection regulating portion 67 is retracted from the deflection space 24 and the slider 60 reaches the advanced position or a position near the advanced position, the unlocking portion 64 of the slider 60 covers the flat surface 22 on the rear end part of the arm main body 21 from above and the suspended portion 59 of the unlocking portion 64 covers the rear end of the arm main body 21 from behind, whereby the rear end part of the arm main body 21 is concealed by the unlocking portion 64 in a plan view (see FIGS. 1 and 12). The pushed positions of the pressing surfaces 69 of the pressing portions 68 are shifted toward the unlocking portion 64 while the pressing means is pressing the pressing surfaces 69 and, subsequently, the pressing means is pushed downwardly (in a direction of an arrow in FIG. 15, toward the deflection space 24). This causes the unlocking portion 64 to be resiliently displaced downwardly via the both coupling/supporting portions 79 and also causes the rear end part of the arm main body 21 pressed by the unlocking portion 64 to be displaced downwardly. Associated with that, the front end part of the arm main body 21 is lifted up. When the front end part of the arm main body 21 is lifted up, the lock projection 23 is disengaged from the lock portion 82 and the two housings 10, 80 can be pulled apart from each other.

As described above, according to the first embodiment, when the slider 60 is pushed forward from the retracted position and, in that state, the unlocking portion 64 is pressed by receiving an operating force F, the rear end part of the lock arm 18 is pressed toward the deflection space 24 by the unlocking portion 64, the lock arm 18 is unlocked and the two housings 10, 80 can be pulled apart from each other. In this case, since the unlocking portion 64 includes the suspended portion 59 suspended toward the deflection space 24 and the deflection regulating portion 67 is also configured to enter the deflection space 24, a height increase of the connector as a whole can be suppressed. If the suspended portion 59 is suspended toward the deflection space 24, external matters such as the wires 300 are unlikely to enter the deflection space 24 for the lock arm 18 and other external forces are also unlikely to act. Thus, it is also possible to avoid the turning-up of the lock arm 18.

Further, since the pressing surfaces 69 of the slider 60 are provided separately from the unlocking portion 64, the unlocking portion 64 does not become unnecessarily large and a height reduction of the connector is easily realized as compared with the case where the pressing surfaces 69 are provided on the unlocking portion 64. In addition, since the pressing surfaces 69 are proximately arranged at the positions overlapping the unlocking portion 64 in the width direction, the pressing means such as fingers can be easily shifted from the pressing surfaces 69 to the unlocking portion 64 and an operation can be substantially performed by one action.

Furthermore, since the coupling portion 63 of the slider 60 covers the lock arm 18 from front at the advanced position, the turning-up of the lock arm 18 can be avoided against external matters and external forces not only from behind, but also from front.

Figure 16:
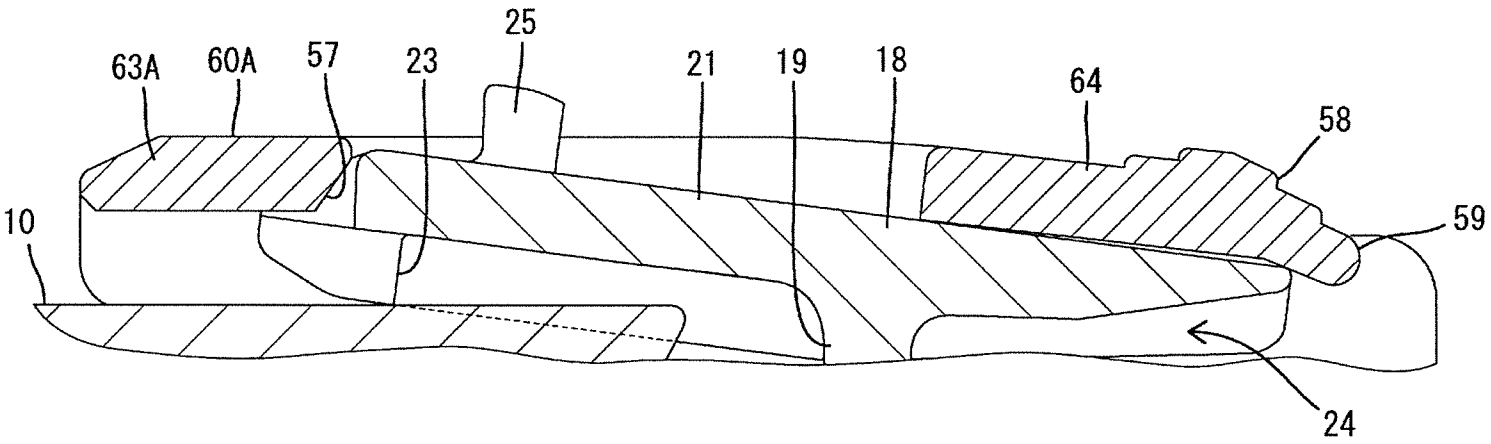
FIG. 16 is an enlarged section of an essential part showing a state immediately before a slider moving from an advanced position toward a retracted position comes into contact with the front end of a lock arm in a second embodiment of the present invention.

FIG. 16 shows a second embodiment of the present invention. In the second embodiment, the shape of a coupling portion 63A of a slider 60A is different from that of the first embodiment, but the other points are as in the first embodiment.

The coupling portion 63 is provided with slanted portions 57 by cutting a corner part of the lower edge of the rear end thereof. The slanted portions 57 are arranged to obliquely face a lower rear side so as to face the front end of a lock arm 18 at an advanced position. Further, although not shown in detail, a pair of the slanted portions 57 are provided on opposite widthwise ends of the coupling portion 63A across a held portion 71.

Conventionally, if an attempt is made to move the slider 60A from the advanced position to a retracted position by spring forces of spring members 90 when the lock arm 18 is still in a deflected state and a front end part of the arm main body 21 is displaced upwardly immediately before two housings 10, 80 reach a properly connected state, the coupling portion 63A interferes with the front end of the arm main body 21 during a movement in some cases. Then, the lock arm 18 and the slider 60A butt against each other and the lock arm 18 may not be released from the deflected state.

However, according to the configuration of the second embodiment, the slanted portions 57 of the coupling portion 63A come into contact with the front end of the arm main body 21 in the process of moving the slider 60A to the retracted position. Thus, the arm main body 21 slides on the slanted portions 57, whereby the lock arm 18 is forcibly returned to a natural state. That is, since the slanted portions 57 of the coupling portion 63A can apply a component of force in a return direction to the lock arm 18, the lock arm 18 is smoothly returned without any trouble.

The present invention is not limited to the above described and illustrated embodiments. For example, the following modes are also included in the technical scope of the present invention.

Other known spring members such as leaf springs may be adopted instead of the coil springs. Further, the spring members may be interposed between the housing and the slider.

Depending on cases, the spring members themselves may be omitted and the slider may be manually moved between the retracted position and the advanced position.

In the assembled state, the upper end of the unlocking portion may be arranged substantially at the same position as the upper end of the holding portion of the arm main body or at a position lower than the upper end of the holding portion by suppressing the height of the upper end of the operating surface. By doing so, a height increase of the connector can be more suppressed.

The slider may be mounted on a male housing.

In pushing the slider to the retracted position, the operating surface of the unlocking portion may be pressed together with the pressing surfaces.

LIST OF REFERENCE SIGNS

10 . . . housing
11 . . . housing main body
18 . . . lock arm
21 . . . arm main body
24 . . . deflection space
25 . . . holding portion
59 . . . suspended portion
60, 60A . . . slider
63, 63A . . . coupling portion
64 . . . unlocking portion
67 . . . deflection regulating portion

68 . . . pressing portion
69 . . . pressing surface
80 . . . mating housing
90 . . . spring member

The invention claimed is:

1. A connector, comprising:

a housing having a front end connectable to a mating housing and a rear end opposite the front end; and a slider mounted movably to an advanced position and a retracted position behind the advanced position with respect to the housing, held at the advanced position while the housing is being connected to the mating housing and permitted to move to the retracted position in a state where the housing is properly connected to the mating housing, wherein:

the housing includes a housing main body, a leg projecting up from the housing main body and a lock arm having a front part projecting forward of the leg and a rear part projecting rearward of the leg, the rear part facing the housing main body via a deflection space;

the rear part of the lock arm is deflected and deformed into the deflection space in the process of connecting the housing to the mating housing and the lock arm is displaced in a return direction to hold the mating housing in a connected state when the housing is properly connected to the mating housing;

the slider includes a deflection regulating portion disposed in the deflection space and facing a lower surface of the rear part of the lock arm when the slider is at the retracted position for regulating deflection of the lock arm into the deflection space; and the slider includes an unlocking portion having a suspended portion with upper and lower surfaces sloped obliquely down to a rear lower side and toward the deflection space, the unlocking portion covers the rear part of the lock arm from a side opposite to the deflection space, the suspended portion covers the rear part of the lock arm from behind and presses the rear part of the lock arm toward the deflection space by receiving an operation force, thereby being able to release a locked state of the lock arm, when the slider reaches the advanced position or a position near the advanced position by being pushed forward from the retracted position.

2. The connector of claim 1, wherein the slider includes a pressing surface that is pressed when the slider is pushed forward from the retracted position, the pressing surface beinq spaced from and lower than the suspended portion and arranged at a position overlapping the unlocking portion in a width direction intersecting with a moving direction of the slider.

3. The connector of claim 2, wherein the slider includes a turning-up regulating portion located at the same side as the unlocking portion with respect to the lock arm and configured to cover the lock arm from the front at the advanced position.

4. The connector of claim 1, wherein the slider includes a turning-up regulating portion located at the same side as the unlocking portion with respect to the lock arm and configured to cover the lock arm from the front at the advanced position.

* * * * *